US008851915B2

(12) United States Patent
Fuma et al.

(10) Patent No.: US 8,851,915 B2
(45) Date of Patent: Oct. 7, 2014

(54) PLUG CAP

(75) Inventors: Tomohiro Fuma, Nagoya (JP); Junpei Ohta, Nagoya (JP); Ryohei Kitamura, Saltama (JP); Takao Yamamoto, Wako (JP); Yutaka Sonoda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 159 days.

(21) Appl. No.: 13/580,831

(22) PCT Filed: Feb. 23, 2011

(86) PCT No.: PCT/JP2011/054042

§ 371 (c)(1),
(2), (4) Date: Sep. 7, 2012

(87) PCT Pub. No.: WO2011/105456

PCT Pub. Date: Sep. 1, 2011

(65) Prior Publication Data

US 2012/0322280 A1 Dec. 20, 2012

(30) Foreign Application Priority Data

Feb. 24, 2010 (JP) ..... 2010-038536

(51) Int. Cl.
*H01R 13/52* (2006.01)
*F02P 13/00* (2006.01)
*H01T 13/06* (2006.01)

(52) U.S. Cl.
CPC ..... *F02P 13/00* (2013.01); *H01T 13/06* (2013.01)
USPC ..... 439/272

(58) Field of Classification Search
USPC ..... 439/272, 578, 125
See application file for complete search history.

(56) References Cited

U.S. PATENT DOCUMENTS 4,514,712 A * 4/1985 McDougal ..... 336/96
5,145,433 A 9/1992 Yagi et al.

(Continued)

FOREIGN PATENT DOCUMENTS

CN 1123363 A 5/1996
CN 1130721 A 9/1996

(Continued)

*Primary Examiner* — Truc Nguyen
(74) *Attorney, Agent, or Firm* — Birch, Stewart, Kolasch & Birch, LLP

(57) ABSTRACT

One object of the invention is to provide a plug cap that more reliably prevents the leakage of current by suppressing the ingress of water from a gap between a terminal body and a rubber member.

A plug cap 1 includes an electrical connection portion 5 that electrically connects a spark plug to a plug cord, a terminal body 2 that is provided on the outer periphery of the electrical connection portion 5, and a cylindrical rubber member 3 which is mounted on at least one of one end portion and the other end portion of the terminal body 2 and into which the spark plug or the like is inserted. The terminal body 2 includes a one end-side insertion portion 41 which is formed at one end of the terminal body and into which the spark plug is inserted and the other end-side insertion portion 42 which is formed at the other end of the terminal body and into which the plug cord is inserted. The rubber member 3 includes an inner cylindrical portion 31 that is inserted into the one end-side insertion portion 41 or the other end-side insertion portion 42, and a cylindrical outer cylindrical portion 32 that is positioned close to the outer periphery of the inner cylindrical portion 31. The inner cylindrical portion 31 includes annular protrusions 35 that come into contact with the inner peripheral surface of the terminal body 2.

18 Claims, 7 Drawing Sheets

(56) References Cited

U.S. PATENT DOCUMENTS

| | | | | | |
|---|---|---|---|---|---|
| 5,324,207 | A | * | 6/1994 | Itoh et al. | 439/125 |
| 5,358,415 | A | * | 10/1994 | Nitta et al. | 439/125 |
| 5,447,429 | A | * | 9/1995 | Nitta et al. | 439/125 |
| 5,456,609 | A | | 10/1995 | Imanishi | |
| 5,592,911 | A | | 1/1997 | Komatsu | |
| 5,618,193 | A | | 4/1997 | Nakajima et al. | |
| 5,628,298 | A | | 5/1997 | Murata | |
| 5,655,491 | A | | 8/1997 | Nishiyama | |
| 5,682,865 | A | | 11/1997 | Maekawa et al. | |
| 5,760,533 | A | | 6/1998 | Saiki et al. | |
| 5,823,802 | A | * | 10/1998 | Bartley | 439/86 |
| 6,273,733 | B1 | * | 8/2001 | Uchiyama | 439/125 |
| 2008/0022984 | A1 | | 1/2008 | Nakao et al. | |

FOREIGN PATENT DOCUMENTS

| | | | |
|---|---|---|---|
| CN | 1054003 | C | 6/2000 |
| EP | 0 509 454 | A2 | 10/1992 |
| EP | 0 615 325 | A2 | 9/1994 |
| JP | 8-312513 | A | 11/1996 |
| JP | 2001-155837 | A | 6/2001 |
| JP | 2002-245400 | A | 8/2002 |
| JP | 2008-95631 | A | 4/2008 |
| JP | 2009-2215 | A | 1/2009 |
| TW | 422466 | U | 2/2001 |

* cited by examiner

PLUG CAP

TECHNICAL FIELD

The present invention relates to a plug cap that electrically connects a spark plug to a plug cord.

BACKGROUND ART

A plug cap electrically connects a spark plug, which is mounted on an internal combustion engine, to a plug cord, which extends from an ignition coil or a distributor, in order to apply a high voltage to the spark plug. As the plug cap, there is known a plug cap including a terminal body which is made of a resin and of which at least both end portions have a cylindrical shape and a cylindrical rubber member that is mounted on an end portion of the terminal body. The rubber member includes a cylindrical inner cylindrical portion, a cylindrical outer cylindrical portion that is disposed close to the outer periphery of the inner cylindrical portion with a predetermined gap interposed therebetween, and a connecting portion that connects the inner cylindrical portion to the outer cylindrical portion. An end portion of the terminal body is fitted between the inner and outer cylindrical portions, so that the rubber member is mounted. In addition, when the plug cap is connected to the spark plug or the plug cord, the spark plug or the like is inserted into the rubber member, so that a gap between the spark plug or the like and the rubber member is sealed (for example, see Patent Document 1 or the like).

Meanwhile, as the terminal body, there is a terminal body that includes concave and convex portions formed on the outer peripheral surface thereof. Further, as the terminal body, there is not only a straight terminal body but also a terminal body that is bent at a predetermined position, in order to cope with a state where the spark plug is assembled on an internal combustion engine. Accordingly, when the above-mentioned terminal body is formed, it is not possible to mold the outer portion of the terminal body by only one mold. Accordingly, the terminal body is generally formed by the molding using a plurality of split molds. For example, as shown in FIGS. 9A and 9B, pins 91 and 92, which are used to define the inner peripheral portion of the terminal body, and split molds 93 and 94, which include molding surfaces corresponding to the outer shape of the terminal body, are disposed at predetermined positions. Then, the split molds are closed. Then, after a cavity (space), which is formed by the pins 91 and 92 and the split molds 93 and 94, is filled with a plasticized resin, the resin is solidified. After that, the split molds 93 and 94 are opened and the pins 91 and 92 are taken out, so that the terminal body is formed.

CITATION LIST

Patent Document

[Patent Document 1] JP-A-2001-155837

SUMMARY OF INVENTION

Problem that the Invention to Solve

When a terminal body is formed by the above-mentioned method, concavity and convexity are not formed on the inner peripheral surface of the terminal body 2 except for abutted portions of the pins 91 and 92, so that the inner peripheral surface of the terminal body becomes a smooth surface.

However, there is a case where a parting line PL, which corresponds to the abutted portions of the split molds 93 and 94 and extends in a longitudinal direction, is formed on the outer peripheral surface of the terminal body 2 as shown in FIG. 9C. For this reason, if the outer cylindrical portion of the rubber member and the outer peripheral surface of the terminal body do not sufficiently come into close contact with each other at a portion where the parting line PL is positioned, it is considered that water enters from a gap between the terminal body and the rubber member. If water enters and permeates the spark plug or the plug cord, the leakage of current occurs. For this reason, it is considered that a high voltage cannot be applied to the spark plug.

Further, in recent years, a compression ratio of an internal combustion engine has been increased in order to improve fuel efficiency and a voltage (required voltage) necessary for spark discharge has been further increased in these internal combustion engines. For this reason, it is considered that the leakage of current occurs even when a very small amount of water enters.

The invention has been made in consideration of the above-mentioned circumstances, and an object of the invention is to propose a plug cap that can more reliably prevent the leakage of current by more reliably preventing water from entering from a gap between a terminal body and a rubber member.

Means for Solving the Problem

The respective structures suitable to achieve the above-mentioned object will be described below in the respective paragraphs. Meanwhile, particular advantages will be described together with corresponding structures according to needs.

Structure 1

A plug cap comprising:

an electrical connection portion that electrically connects a spark plug to a plug cord, the spark plug being connected to one end of the electrical connection portion and the plug cord being connected to the other end of the electrical connection portion;

a terminal body that is made of a resin, is provided on an outer periphery of the electrical connection portion, and includes a one end-side insertion portion which is formed at one end of the terminal body and into which the spark plug is inserted and the other end-side insertion portion which is formed at the other end of the terminal body and into which the plug cord is inserted, at least the one end-side insertion portion and the other end-side insertion portion being formed in a cylindrical shape; and a cylindrical rubber member which is mounted on at least one of one end portion and the other end portion of the terminal body and into which the spark plug or the plug cord is inserted, wherein the rubber member includes a cylindrical inner cylindrical portion that is inserted into the one end-side insertion portion or the other end-side insertion portion of the terminal body, a cylindrical outer cylindrical portion that is positioned close to the outer periphery of the inner cylindrical portion and is disposed with the terminal body interposed between the outer cylindrical portion and the inner cylindrical portion, and a connecting portion that connects the outer cylindrical portion to the inner cylindrical portion, and the inner cylindrical portion includes an annular protrusion that comes into contact with the inner peripheral surface of the terminal body.

According to Structure 1, the spark plug or the plug cord is inserted into the one end-side insertion portion or the other end-side insertion portion, so that the inner cylindrical portion into which the insertion portion is inserted is expanded outward in a radial direction.

For this reason, the protrusions, which are formed on the outer peripheral portion of the inner cylindrical portion, come into press contact with the inner peripheral surface of the terminal body.

Further, as described above, in terms of manufacture, a parting line, which extends in a longitudinal direction, is generally formed on the outer peripheral surface of the terminal body. On the other hand, the inner peripheral surface of the terminal body becomes smooth so that a parting line extending in the longitudinal direction is not formed. That is, according to Structure 1, the protrusions come into press contact with the inner peripheral surface of the terminal body having a smooth shape by the insertion of the spark plug or the like. Accordingly, it is possible to make the protrusions come into close contact with the terminal body without clearance over the entire area in the circumferential direction of the terminal body. As a result, it is possible to effectively suppress the ingress of water from the gap between the terminal body and the rubber member. Consequently, it is possible to more reliably prevent leakage of current.

Structure 2

In the plug cap of Structure 1, the rubber member is mounted on the one end portion of the terminal body, the electrical connection portion includes a connector bracket of which one end portion comes into contact with the spark plug, and a leading end portion of the inner cylindrical portion, which faces the other end of the terminal body, extends to one end face of the connector bracket or is positioned closer to the other end portion of the terminal body than the one end face of the connector bracket.

Meanwhile, the meaning of "the leading end portion of the inner cylindrical portion extends to one end face of the connector bracket" includes not only a case where the leading end portion of the inner cylindrical portion comes into contact with one end portion of the connector bracket but also a case where the leading end portion of the inner cylindrical portion is distant from the one end portion of the connector bracket by a distance of 1.5 mm or less due to the influence of the manufacturing tolerance.

Since the temperature of an internal combustion engine, which is being used, is high, the temperature of the plug cap connected to the spark plug also becomes relatively high. In this case, air, which exists in the one end-side insertion portion into which the spark plug is inserted, is expanded, so that the air is let out of the gap between the terminal body and the rubber member or the like. Meanwhile, when the plug cap is cooled after being used, air enters toward the one end-side insertion portion having low air pressure through the gap between the terminal body and the rubber member since air is let out of the gap between the terminal body and the rubber member. In this case, it is considered that water enters the one end-side insertion portion together with the air.

In this regard, according to Structure 2, the leading end portion of the inner cylindrical portion extends to one end face of the connector bracket or extends closer to one end face of the connector bracket than the other end portion of the terminal body.

For this reason, it is possible to reduce the amount of air that exists in the one end-side insertion portion into which the spark plug is inserted. Accordingly, it is possible to reduce the amount of air that enters from the gap between the terminal body and the rubber member. As a result, it is possible to even more reliably prevent the ingress of water.

Structure 3

In the plug cap of Structure 1 or 2, at least one of the annular protrusion, which is provided at the inner cylindrical portion, is formed on the inner cylindrical portion in a range of the length of the outer cylindrical portion.

For example, when an internal combustion engine is not in use, the air pressure in the one end-side insertion portion or the other end-side insertion portion is substantially equal to the air pressure on the outside. Accordingly, in this case, it is considered that water enters only up to substantially the same height as the length (height) of the outer cylindrical portion from the connecting portion between the inner cylindrical portion and the terminal body.

In this regard, according to Structure 3, at least one of the protrusions is formed on the inner cylindrical portion in the range of the length of the outer cylindrical portion, that is, on a portion of the inner cylindrical portion that is positioned close to the inner periphery of the outer cylindrical portion. That is, the protrusions are formed at a portion where there is a significant concern in terms of the ingress of water. As a result, it is possible to effectively suppress the ingress of water from the gap between the terminal body and the rubber member (inner cylindrical portion).

Structure 4

In the plug cap of Structure 3, the spark plug includes:

a cylindrical metal shell; and an insulator which is inserted into the metal shell and of which a rear end-side body portion is exposed from the metal shell, a step portion and a cylindrical portion, which is positioned closer to the metal shell than the step portion, are formed on the outer periphery of the rear end-side body portion, and the rear end-side body portion is inserted into the one end-side insertion portion when the plug cap is connected to the spark plug, the rubber member is mounted on the one end portion of the terminal body, and the annular protrusion is formed on the inner cylindrical portion at a position that faces the cylindrical portion of the rear end-side body portion when the plug cap is connected to the spark plug.

In order to prevent a high voltage, which is applied from the plug cap, from leaking to the metal shell along the surface of the insulator (rear end-side body portion), it may be possible to further increase the creeping distance of the rear end-side body portion by forming the recessed step portion at the rear end-side body portion in the spark plug.

Taking this into consideration, according to Structure 4, the protrusions are formed at positions facing the position (that is, cylindrical portion) avoiding the step portion of the insulator. For this reason, when the spark plug is inserted into the plug cap, it is possible to more reliably make the protrusions come into press contact with the inner peripheral surface of the terminal body. Further, since the protrusions are formed, it is possible to more reliably make the cylindrical portion of the insulator and the inner cylindrical portion of the rubber member come into close contact with each other. As a result, it is possible to improve sealability both between the rubber member and the terminal body and between the rubber member and the spark plug at one stroke, and to further suppress the ingress of water.

Structure 5

In the plug cap of any one of Structures 1 to 4, a length of the inner cylindrical portion from the connecting portion is larger than a length of the outer cylindrical portion from the connecting portion.

According to Structure 5, the length of the inner cylindrical portion from the connecting portion is set to be larger than the length of the outer cylindrical portion from the connecting portion. That is, the length of the inner cylindrical portion, which more reliably comes into close contact with the inner peripheral surface of the terminal body by the contact of the spark plug or the like, is set to be relatively large. Accordingly, it is possible to more effectively suppress the ingress of water from the gap between the terminal body and the rubber member.

Further, when the air pressure in the one end-side insertion portion or the other end-side insertion portion is substantially equal to the air pressure on the outside as described above, it is considered that water enters only up to substantially the same height as the length (height) of the outer cylindrical portion from the connecting portion between the inner cylindrical portion and the terminal body. In this regard, according to Structure 5, the length of the inner cylindrical portion from the connecting portion is set to be larger than the length of the outer cylindrical portion from the connecting portion (that is, the height where the entering water can reach). Accordingly, even if water enters up to substantially the same height as the height of the outer cylindrical portion from the connecting portion between the inner cylindrical portion and the terminal body, it is possible to more reliably prevent water from entering toward the spark plug or the like beyond the inner cylindrical portion.

Structure 6

In the plug cap of any one of Structures 1 to 5, a reduced-diameter portion, of which a diameter is reduced stepwise and/or continuously toward an opposite end portion of the terminal body opposite to the end portion of both end portions of the terminal body on which the rubber member is mounted, is formed at a leading end portion of the outer cylindrical portion facing the opposite end portion.

According to Structure 6, the reduced-diameter portion, which is formed in a tapered shape toward the end portion opposite to the end portion of the terminal body on which the rubber member including the outer cylindrical portion is mounted, is formed at the leading end portion of the outer cylindrical portion. Accordingly, it is possible to prevent water from standing between the terminal body and the leading end portion of the outer cylindrical portion as much as possible. Consequently, it is possible to more reliably prevent the ingress of water.

DESCRIPTION OF EMBODIMENTS

Figure 1:
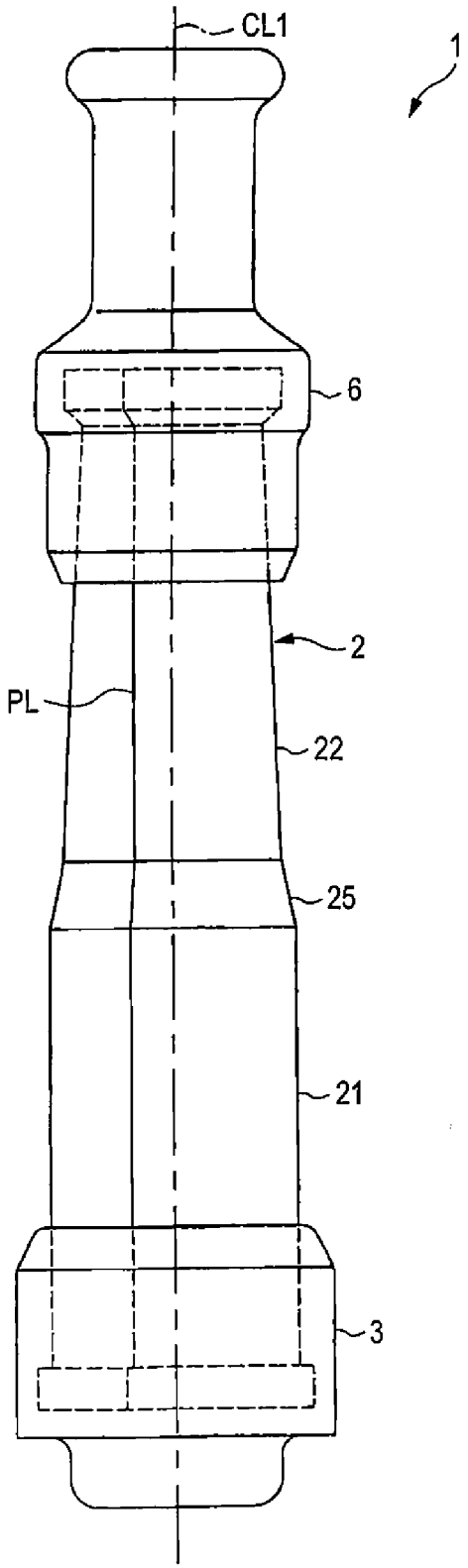
FIG. 1 is a front view showing the structure of a plug cap.
Figure 2:
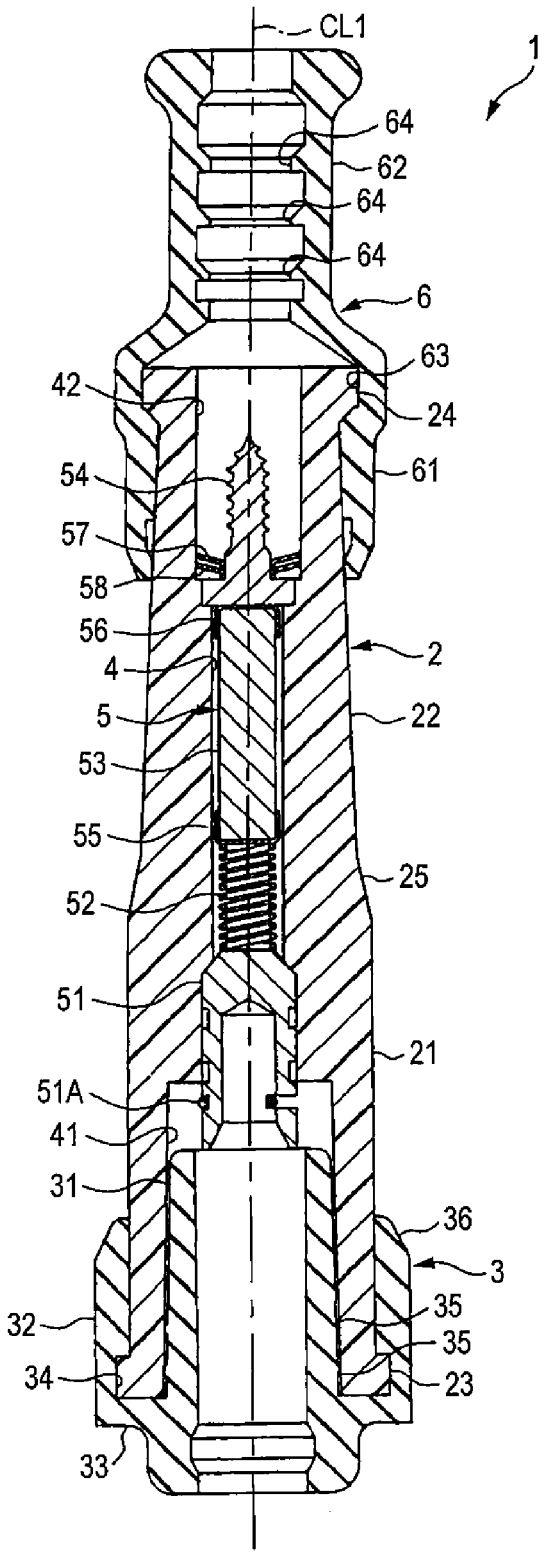
FIG. 2 is a cross-sectional view showing the structure of the plug cap.

An embodiment will be described below with reference to the drawings. FIG. 1 is a front view of a plug cap 1, and FIG. 2 is a cross-sectional view of the plug cap 1. Meanwhile, in FIGS. 1 and 2, the direction of an axis CL1 of the plug cap 1 is referred to as a vertical direction, the lower side of the plug cap is referred to as one end-side of the plug cap 1, and the upper side of the plug cap is referred to as the other end-side of the plug cap 1.

The plug cap 1 includes a terminal body 2 that has a cylindrical shape, a plug-side rubber member 3 (which corresponds to a rubber member in the invention) that is mounted on one end of the terminal body, and the like.

The terminal body 2 is formed in a straight shape, and is made of a resin (for example, a phenol resin) that has heat resistance and voltage resistance. Further, the outer portion of the terminal body 2 includes a one end-side body portion 21 that has a relatively large diameter and the other end-side body portion 22 that is formed on the other end-side of the one end-side body portion 21 and has a diameter smaller than the diameter of the one end-side body portion 21. In addition, a flange-like one end-side engaging portion 23, which protrudes outward in a radial direction, is formed on the outer periphery of one end portion of the terminal body 2. Meanwhile, the other end-side engaging portion 24, which protrudes outward in the radial direction and is formed in the shape of a flange, is formed on the outer periphery of the other end portion of the terminal body 2. Moreover, a tapered portion 25 of which the diameter decreases toward the other end-side in the direction of the axis CL1 is formed at a connecting portion between the one end-side body portion 21 and the other end-side body portion 22.

Meanwhile, the terminal body 2 is formed by molding, and a parting line PL extending along the axis CL1 is formed on the outer peripheral surface of the terminal body 2 from one end of the terminal body 2 to the other end of the terminal body. On the other hand, the parting line PL extending along the axis CL1 is not formed on the inner peripheral surface of the terminal body 2, and the inner peripheral surfaces of at least both end portions of the terminal body 2 (one end-side insertion portion 41 and the other end-side insertion portion 42 to be described below) are formed smoothly (evenly).

Further, a shaft hole 4 extending along the axis CL1 is formed in the terminal body 2.

A one end-side insertion portion 41 having a cylindrical shape into which a terminal electrode of a spark plug (not shown) mounted on an internal combustion engine (not shown) is inserted is formed at one end portion of the shaft hole 4. On the other hand, the other end-side insertion portion 42 having a cylindrical shape into which a plug cord (not shown) extending from a distributor or an ignition coil (not shown) is inserted is formed at the other end portion of the shaft hole 4. Meanwhile, in this embodiment, the plug cap 1 extends in the vertical direction and is connected to a spark plug. The one end-side insertion portion 41 is disposed on the lower side and the other end-side insertion portion 42 is disposed on the upper side.

Moreover, an electrical connection portion 5, which electrically connects the spark plug to the plug cord, is provided in the shaft hole 4. A connector bracket 51, a contact spring 52, a resistor 53, and a cord mounting screw 54 are connected in series from one end-side toward the other end-side, so that the electrical connection portion 5 is formed.

The connector bracket 51 is formed in a bottomed cylindrical shape and is made of conductive metal (for example, brass). One end portion of the connector bracket is disposed in the one end-side insertion portion 41. In addition, an annular connector spring 51A is mounted on the outer periphery of one end portion of the connector bracket 51. Further, when the plug cap 1 is connected to the spark plug, a fastening force directed to the inside in a radial direction is applied to the terminal electrode of the spark plug from the connector spring 51A. As a result, the connector bracket 51 can be stably connected to the spark plug.

The contact spring 52 is made of conductive metal (for example, stainless steel). One end portion of the contact spring comes into contact with the other end portion of the connector bracket 51, and the other end portion of the contact spring comes into contact with a contact cap 55 that is fitted to one end of the resistor 53 and made of metal. Vibration resistance is improved by the contact spring 52, so that electrical connection is stably maintained between the connector bracket 51 and the cord mounting screw 54.

In addition, the resistor 53 is formed in a substantially columnar shape, is made of conductive ceramic, and has a predetermined electrical resistance (for example, 5 kΩ). Further, a contact cap 56 made of metal is disposed at the other end portion of the resistor 53, so that the other end portion of the resistor 53 and the cord mounting screw 54 are electrically connected to each other by the contact cap 56.

The cord mounting screw 54 is made of conductive metal (for example, brass), and is formed in the shape of a wood screw tapered toward the other end-side. Further, the other end portion (screw-shaped portion) of the cord mounting screw 54 protrudes toward the other end-side insertion portion 42. Furthermore, when the plug cord is to be connected, the end portion of the plug cord is screwed into the cord mounting screw 54 while being inserted into the other end-side insertion portion 42. As a result, conductive wires of the plug cord are electrically connected to the cord mounting screw 54. Meanwhile, two washers 57 and 58, which are formed in an annular shape, are fitted to the outer periphery of the base end portion of the cord mounting screw 54. The washers 57 and 58 fix the cord mounting screw 54 to the terminal body 2, and prevent the cord mounting screw 54 from falling down when the plug cord is to be connected and the like.

In addition, a cylindrical cord-side rubber member 6, into which the plug cord is inserted when the plug cord is connected, is mounted on the other end portion of the terminal body 2. The cord-side rubber member 6 is made of a predetermined rubber (for example, EPDM rubber) and is formed in the shape of a cylinder extending along the axis CL1. Further, the cord-side rubber member 6 includes a large-diameter portion 61 and a small-diameter portion 62. The large-diameter portion 61 is formed at one end portion of the cord-side rubber member and has an inner diameter substantially equal to the outer diameter of the other end-side insertion portion 42. The small-diameter portion 62 is formed at the other end portion of the large-diameter portion 61 and has a diameter smaller than the inner diameter of the large-diameter portion 61.

In addition, an annular engaged portion 63 having a concave shape is formed on the inner peripheral surface of the other end portion of the large-diameter portion 61. Further, when one end portion of the terminal body 2 is inserted into the large-diameter portion 61 and the other end-side engaging portion 24 of the terminal body 2 is engaged with the engaged portion 63, when the cord-side rubber member 6 is mounted on the other end portion of the terminal body 2.

Furthermore, a plurality of annular convex portions 64, which protrudes inward in the radial direction, is formed on the inner peripheral surface of the small-diameter portion 62. For this reason, when the plug cord is inserted into the cord-side rubber member 6, the convex portion 64 and the outer peripheral surface of the plug cord come into close contact with each other. As a result, ingress of water into the other end-side insertion portion 42 is prevented.

In addition, the cylindrical plug-side rubber member 3, into which the terminal electrode of the spark plug is inserted when the plug cap is connected to the spark plug, is mounted on one end portion of the terminal body 2. The plug-side rubber member 3 is made of a predetermined rubber (for example, silicon rubber). The plug-side rubber member 3 includes an inner cylindrical portion 31, an outer cylindrical portion 32, and a connecting portion 33 that connects the inner cylindrical portion 31 to a base end portion of the outer cylindrical portion 32.

The inner cylindrical portion 31 has a cylindrical shape and is inserted into the one end-side insertion portion 41 of the terminal body 2, so that the outer periphery of the inner cylindrical portion 31 comes into contact with the inner peripheral surface of one end portion of the terminal body 2. Further, when the plug cap 1 is connected to the spark plug, the inner cylindrical portion 31 is expanded outward in the radial direction by the spark plug.

Furthermore, the outer cylindrical portion 32 has a cylindrical shape and is disposed on the outer periphery of the inner cylindrical portion 31 with one end portion of the terminal body 2 interposed therebetween. In addition, an annular engaged portion 34 having a concave shape is formed on the inner peripheral surface of one end portion of the outer cylindrical portion 32. One end portion of the terminal body 2 is fitted between the inner cylindrical portion 31 and the outer cylindrical portion 32 while the one end-side engaging portion 23 is engaged with the engaged portion 34. Accordingly, the plug-side rubber member 3 is mounted on one end portion of the terminal body 2.

Figure 3:
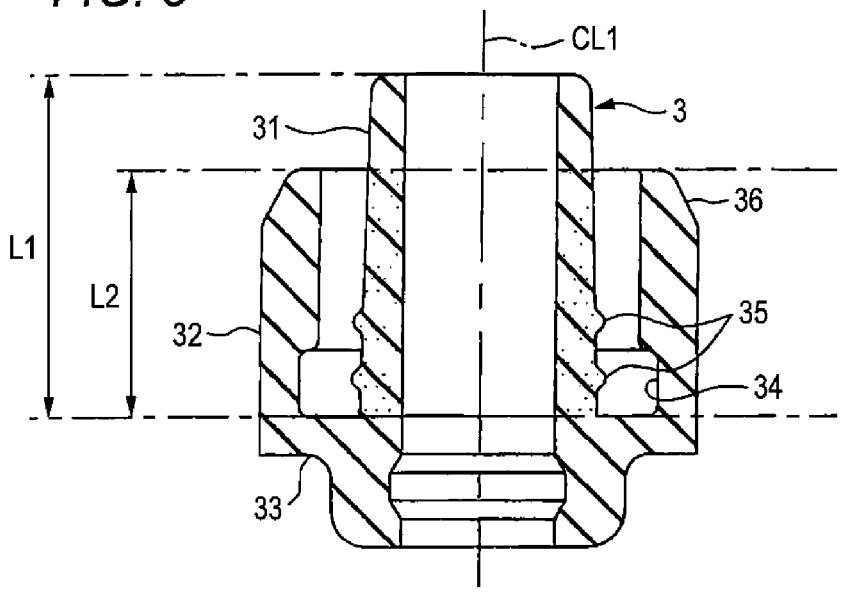
FIG. 3 is a partially enlarged cross-sectional view showing the structure of a plug-side rubber member.

Moreover, in this embodiment, two annular protrusions 35, which extend in the circumferential direction, are formed on the outer peripheral portion of the inner cylindrical portion 31 as shown in FIGS. 2 and 3 (meanwhile, only the plug-side rubber member 3 is extracted and shown in FIG. 3). The protrusions 35 are formed on the inner cylindrical portion 31 in the range of a length L2 of the outer cylindrical portion 32 from the connecting portion 33 along the axis CL1, that is, on a portion (a portion having a dotted pattern in FIG. 3) of the inner cylindrical portion 31 positioned close to the inner periphery of the outer cylindrical portion 32. Since the inner cylindrical portion 31 is expanded outward in the radial direction as described above when the plug cap 1 is connected to the spark plug, the protrusions 35 come into press contact with the inner peripheral surface of one end portion of the terminal body 2.

In addition, the leading end portion of the inner cylindrical portion 31 extends to one end face of the connector bracket 51. Specifically, the inner cylindrical portion 31 is formed so that the position of the leading end portion of the inner cylindrical portion 31 is substantially the same as the position of the leading end portion of the connector bracket 51 along the axis CL1.

Further, the inner cylindrical portion 31 is formed relatively long along the direction of the axis CL1. For this reason, a length L1 of the inner cylindrical portion 31 from the connecting portion 33 along the axis CL1 is set to be larger than the length L2 of the outer cylindrical portion 32 from the connecting portion 33 along the axis CL1.

Furthermore, a reduced-diameter portion 36, of which the diameter is continuously reduced toward the opposite end portion (the other end-side in this embodiment), is formed at the leading end portion of the outer cylindrical portion 32 [the portion of the outer cylindrical portion facing the opposite end portion of the terminal body opposite to the end portion of both end portions of the terminal body 2 on which the rubber member (the plug-side rubber member 3 in this embodiment) is mounted].

As described above, according to this embodiment, the protrusions 35 come into press contact with the terminal body 2 by the insertion of the spark plug into the inner peripheral surface of the terminal body 2 having a smooth shape. Accordingly, it is possible to make the protrusions 35 come into close contact with the terminal body 2 without clearance over the entire area in the circumferential direction of the terminal body. As a result, it is possible to effectively suppress the ingress of water from a gap between the terminal body 2 and the plug-side rubber member 3. Consequently, it is possible to more reliably prevent leakage of current.

Moreover, the protrusions 35 are formed at the positions where there is a concern that water enters up to substantially the same height as the length (height) L2 of the outer cylindrical portion 32 from the connecting portion 33 between the inner cylindrical portion 31 and the terminal body 2, in this embodiment, on the inner cylindrical portion 31 in the range of the length of the outer cylindrical portion 32. That is, the protrusions 35 are formed so as to correspond to the portions where there is a further concern that the ingress of water occurs. As a result, it is possible to more effectively suppress the ingress of water from the gap between the terminal body 2 and the plug-side rubber member 3 (the inner cylindrical portion 31).

In addition, since the leading end portion of the inner cylindrical portion extends to one end face of the connector bracket, it is possible to reduce the amount of air that exists in the one end-side insertion portion 41. Accordingly, when the plug cap 1 is cooled, it is possible to reduce the amount of air that enters from the gap between the terminal body 2 and the plug-side rubber member 3 and to more reliably prevent the ingress of water.

Further, the length L1 of the inner cylindrical portion 31, which more reliably comes into close contact with the inner peripheral surface of the terminal body 2 by the contact of the spark plug, is set to be larger than the length L2 of the outer cylindrical portion 32. For this reason, it is possible to more reliably seal the gap between the terminal body 2 and the plug-side rubber member 3 and to more reliably prevent the ingress of water.

Furthermore, the length L1 of the inner cylindrical portion is set to be larger than the length L2 of the outer cylindrical portion (that is, the height where the entering water can reach). Accordingly, even if water enters up to substantially the same height as the length L2 of the outer cylindrical portion 32 between the inner cylindrical portion 31 and the terminal body 2, it is possible to more reliably prevent water from entering toward the spark plug beyond the inner cylindrical portion 31.

In addition, since the reduced-diameter portion 36, which is formed in a tapered shape toward the other end-side, is formed at the leading end portion of the outer cylindrical portion 32, it is possible to prevent water from standing between the terminal body 2 and the leading end portion of the outer cylindrical portion 32 as much as possible. As a result, it is possible to more reliably prevent the ingress of water.

Meanwhile, the invention is not limited to the description of the above-mentioned embodiment, and may be embodied, for example, as described below. Of course, the invention may naturally have other applications or modifications that are not shown below.

Figure 4:
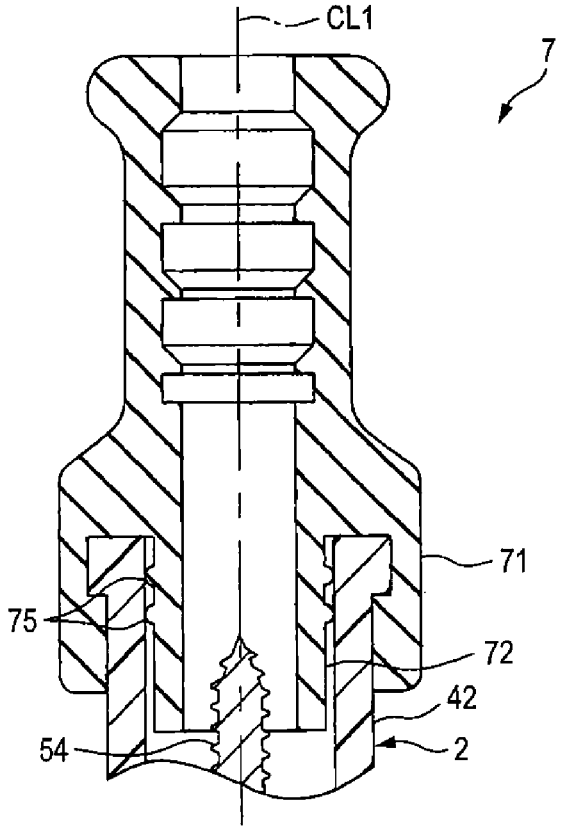
FIG. 4 is a partially enlarged cross-sectional view showing the structure of a cord-side rubber member of another embodiment.

(a) In the above-mentioned embodiment, the technical idea of the invention has been applied to the plug-side rubber member 3 that is mounted on one end portion of the terminal body 2. However, the technical idea of the invention may be applied to the cord-side rubber member that is mounted on the other end portion of the terminal body 2. That is, as shown in FIG. 4, a cord-side rubber member 7 may includes an outer cylindrical portion 71 (which corresponds to the large-diameter portion 61 in the above-mentioned embodiment), and an inner cylindrical portion 72 that is positioned close to the inner periphery of the outer cylindrical portion 71. Annular protrusions 75, which protrude outward in a radial direction, are formed on the outer peripheral surface of the inner cylindrical portion 72. In this case, when a plug cord is connected, the inner cylindrical portion 71 is expanded outward in the radial direction. As a result, the protrusions 75 come into press contact with the inner peripheral surface of the other end portion of the terminal body 2. For this reason, the inner peripheral surface of the other end-side insertion portion 42 has a smooth shape and it is possible to effectively suppress the ingress of water from a gap between the terminal body 2 and the cord-side rubber member 7. Consequently, it is possible to more reliably prevent leakage of current.

Meanwhile, the technical idea of the invention may be applied to both the plug-side rubber member and the cord-side rubber member. Further, a reduced-diameter portion, of which the diameter is reduced stepwise and/or continuously toward the opposite end portion (one end-side), may be formed at the leading end portion of the outer cylindrical portion 71 [the portion of the outer cylindrical portion facing the opposite end portion of the terminal body opposite to the end portion of both end portions of the terminal body 2 on which the rubber member (the cord-side rubber member 7 in this embodiment) is mounted].

Figure 5:
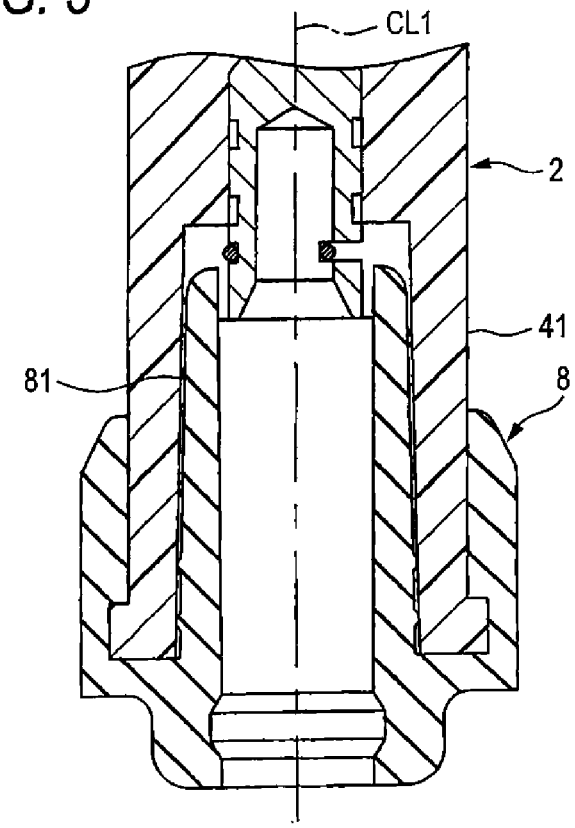
FIG. 5 is a partially enlarged cross-sectional view showing the structure of an inner cylindrical portion and the like of another embodiment.

(b) In the above-mentioned embodiment, the inner cylindrical portion 31 has been formed so that the position of the leading end portion of the inner cylindrical portion 31 is substantially the same as the position of the leading end portion of the connector bracket 51 along the axis CL1. A plug-side rubber member 8 may be formed so that an inner cylindrical portion 81 further extends and the leading end portion of the inner cylindrical portion 81 is positioned closer to the other end-side of a terminal body 2 than one end face of a connector bracket 51 as shown in FIG. 5. In this case, it is possible to further reduce the amount of air that exists in a one end-side insertion portion 41. As a result, it is possible to more reliably prevent water from entering from a gap between the terminal body 2 and the plug-side rubber member 8.

Figure 6:
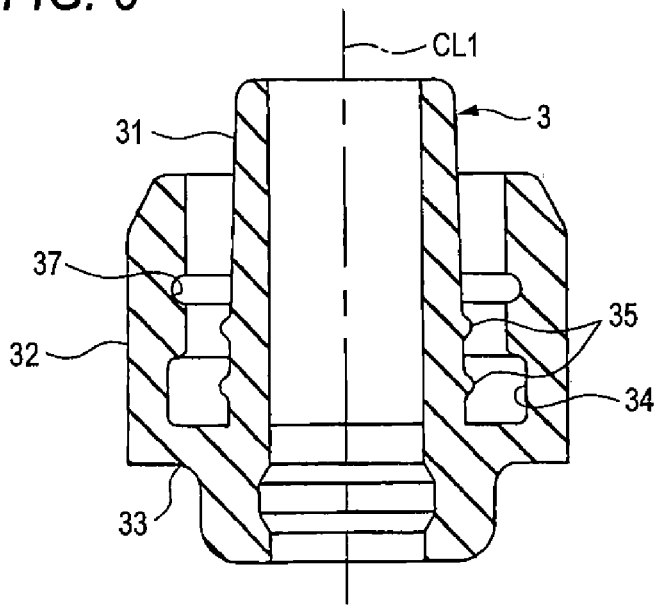
FIG. 6 is a partially enlarged cross-sectional view showing the structure of an outer cylindrical portion and the like of another embodiment.

(c) Although not particularly described in the above-mentioned embodiment, an annular concave portion 37 may be formed on the inner peripheral surface of an outer cylindrical portion 32 as shown in FIG. 6. In this case, a portion of the inner peripheral surface of the outer cylindrical portion 32 except for the concave portion 37 comes into close contact with the outer peripheral surface of one end portion of the terminal body 2 with larger pressure. As a result, it is possible to even more reliably prevent the ingress of water.

Figure 7:
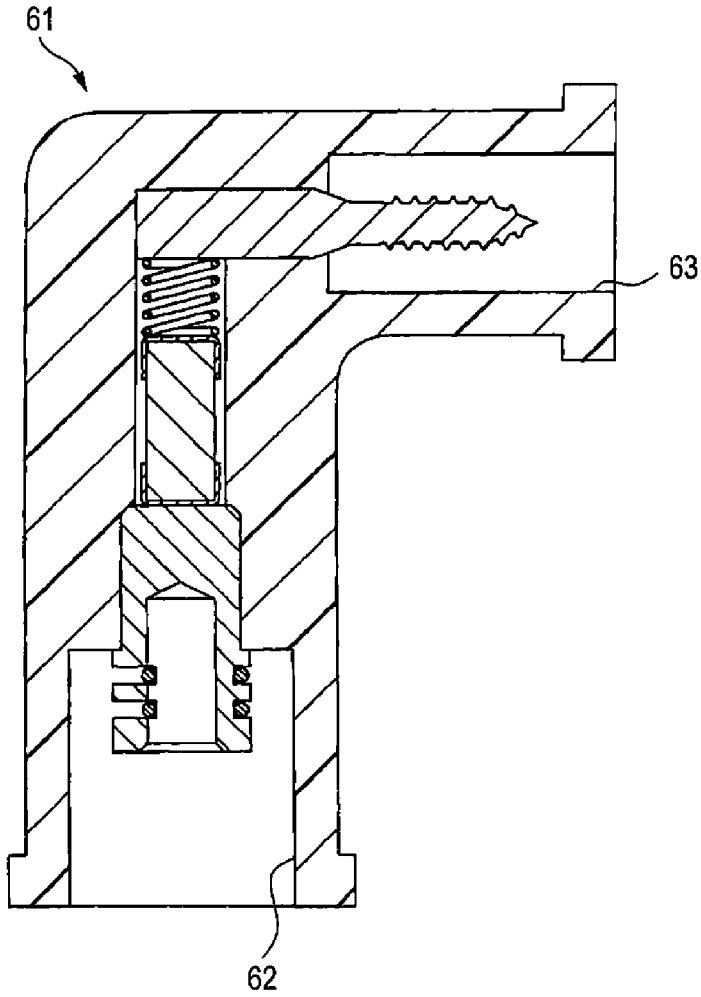
FIG. 7 is a cross-sectional view showing the structure of a terminal body and the like of another embodiment.

(d) In the above-mentioned embodiment, the terminal body 2 has been formed in the shape of a cylinder extending along the axis CL1. At least the one end-side insertion portion and the other end-side insertion portion of the terminal body may be formed in the shape of a cylinder. Accordingly, for example, the technical idea of the invention may be applied to a terminal body 61 of which a substantially middle portion has a bent shape and a one end-side insertion portion 62 and the other end-side insertion portion 63 have a cylindrical shape as shown in FIG. 7 (Meanwhile, a rubber member is not shown in FIG. 7).

Figure 8:
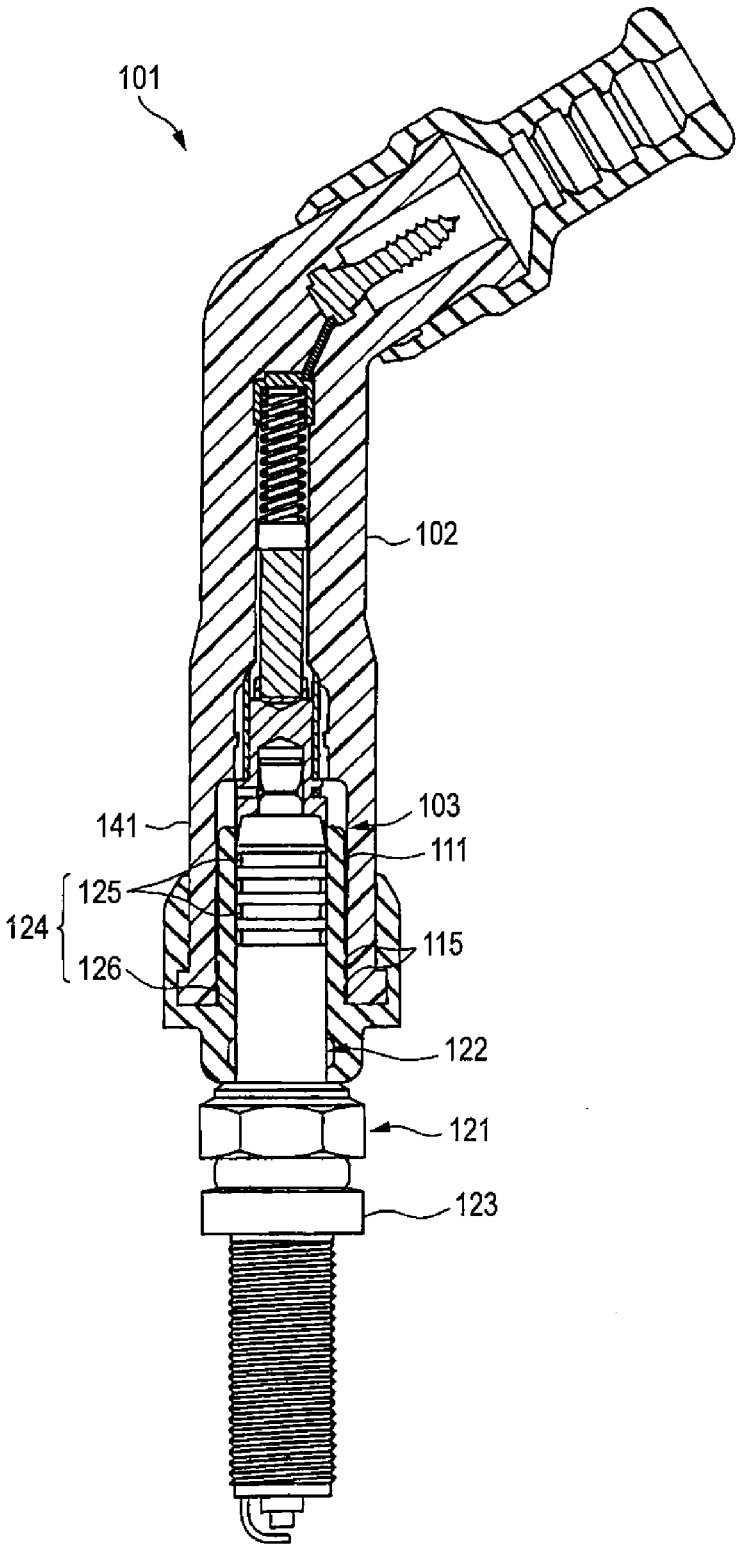
FIG. 8 is a partially sectional front view showing the structure of an inner cylindrical portion and the like of another embodiment.
Figure 9A:
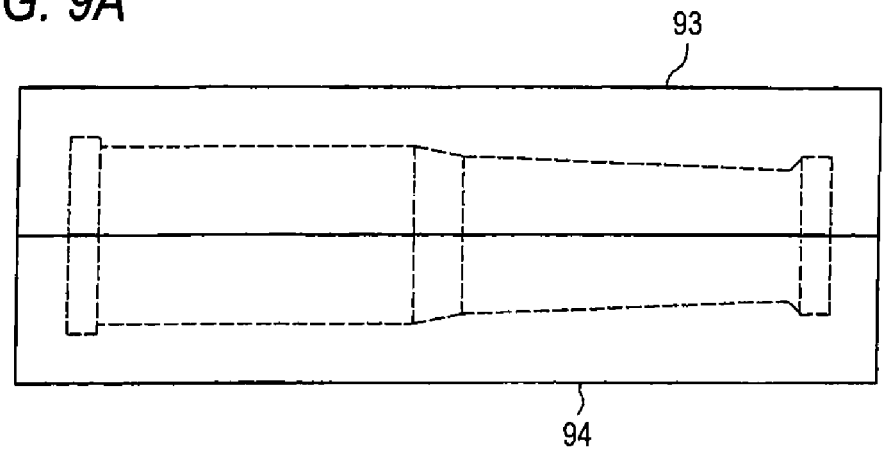
FIG. 9A is a front view of a split mold that is used to form a terminal body.
Figure 9B:
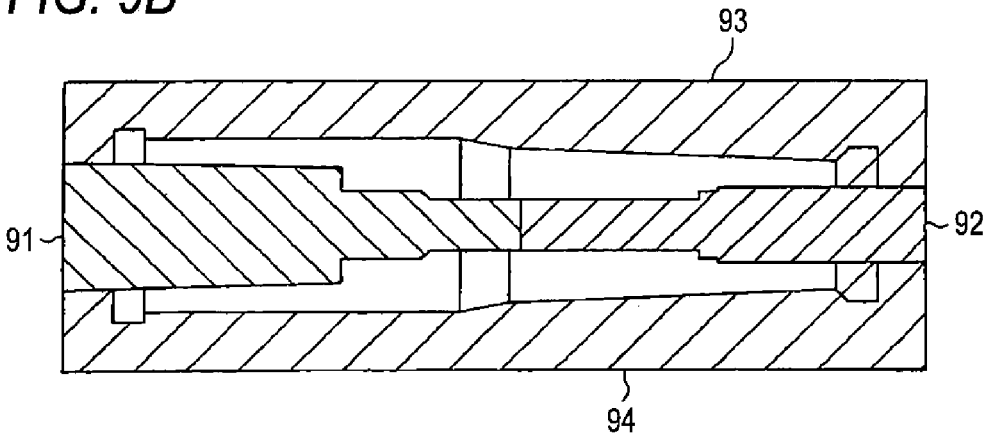
FIG. 9B is a cross-sectional view of the split mold and the like, and FIG. 9C is a front view of the formed terminal body.
Figure 9C:
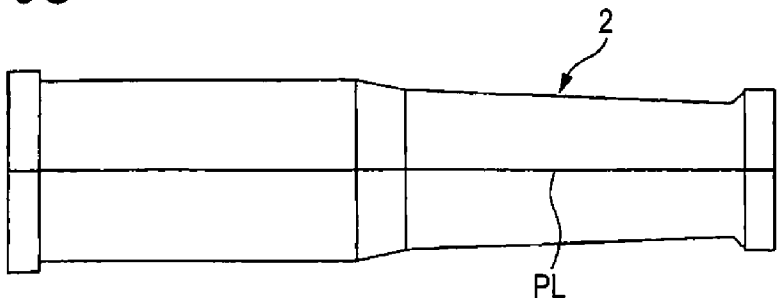

(e) In the above-mentioned embodiment, the suppression of the ingress of water has been intended irrespective of the structure of the spark plug where the plug cap 1 is mounted. However, an effect of suppressing the ingress of water may be further improved by using the structure of the spark plug to be mounted. That is, as shown in FIG. 8, a general spark plug 121 includes a cylindrical insulator 122 and a cylindrical metal shell 123 provided on the outer periphery of the insulator 122. A rear end-side body portion 124, which is exposed from the metal shell 123 and inserted into a one end-side insertion portion 141 of a plug cap 101, is provided at the other end portion of the insulator 122. Further, in order to prevent the leakage of current that is along the surface of the rear end-side body portion 124, recessed annular step portions 125 and a cylindrical portion 126, which is positioned closer to the metal shell 123 than the step portions 125 and have smooth surfaces, are formed on the outer periphery of the rear end-side body portion 124. Accordingly, the creeping distance of the rear end-side body portion 124 is increased. In this spark plug 121, annular protrusions 115 may be formed on an inner cylindrical portion 111 of a plug-side rubber member 103 at positions that face the cylindrical portion 126 when the plug cap 101 is connected to the spark plug 121 (positions close to the outer periphery of the cylindrical portion 126). In this case, when the spark plug 121 is inserted into the plug cap 101, it is possible to more reliably make the protrusions 115 come into press contact with the inner peripheral surface of the terminal body 102. In addition, since the protrusions 115 are formed, it is possible to more reliably make the cylindrical portion 126 and the inner cylindrical portion 111 come into close contact with each other. As a result, it is possible to improve sealability both between the plug-side rubber member 103 and the terminal body 102 and between the plug-side rubber member 103 and the spark plug 121 at one stroke, and to further suppress the ingress of water.

(f) In the above-mentioned embodiment, the reduced-diameter portion 36, of which the diameter is continuously reduced toward the other end-side, has been formed at the leading end portion of the outer cylindrical portion 32. However, the reduced-diameter portion may be formed so that the diameter of the reduced-diameter portion is reduced stepwise.

(g) In the above-mentioned embodiment, the connector bracket 51, the contact spring 52, and the like are connected, so that the electrical connection portion 5 has been formed. The structure of the electrical connection portion is not limited thereto. That is, as long as the spark plug and the plug cord are electrically connected to each other, any one may be used as the electrical connection portion. Accordingly, the contact spring 52 and the cord mounting screw 54 may be electrically connected to each other without the resistor 53. Further, a conductive wire, which electrically connects the spark plug to the plug cord, is provided and an electrical connection portion may be formed of the conductive wire.

(h) In the above-mentioned embodiment, a phenol resin has been exemplified as the resin that is used to form the terminal body 2. However, the resin, which is used to form the terminal body 2, is not limited thereto. Accordingly, for example, an unsaturated polyester resin may be used. Further, a thermosetting resin is preferably used as the resin that is used to form the terminal body 2. However, a resin having excellent heat resistance may be used, and a thermoplastic resin (for example, a PPS resin and the like) may be used.

(i) In the above-mentioned embodiment, EPDM rubber or silicon rubber has been exemplified as rubber that is used to form the plug-side rubber member 3 or the cord-side rubber member 6. However, the rubber, which is used to form the plug-side rubber member 3 or the like, is not limited thereto. Accordingly, the plug-side rubber member 3 or the like may be made of, for example, rubber having heat resistance enough against the heat generated by an internal combustion engine, such as acrylic rubber.

The invention has been described in detail with reference to specific embodiments, but it is apparent to those skilled in the art that the invention may have various modifications or alterations without departing from the spirit and scope of the invention.

This application is based on Japanese Patent Application No. 2010-038536 filed Feb. 24, 2010, and the entire contents of the application noted above are hereby incorporated by reference.

REFERENCE SIGNS LIST

1 . . . plug cap
2 . . . terminal body
3 . . . plug-side rubber member (rubber member)
5 . . . electrical connection portion
6 . . . cord-side rubber member
31 . . . inner cylindrical portion
32 . . . outer cylindrical portion
33 . . . connecting portion
35 . . . protrusion
36 . . . reduced-diameter portion
41 . . . one end-side insertion portion
42 . . . the other end-side insertion portion
51 . . . connector bracket

The invention claimed is:

1. A plug cap comprising:

an electrical connection portion that electrically connects a spark plug to a plug cord, the spark plug being connected to one end of the electrical connection portion and the plug cord being connected to an opposite end of the electrical connection portion;

a terminal body that is made of a resin, is provided on an outer periphery of the electrical connection portion, and includes a one end-side insertion portion formed at one end of the terminal body and into which the spark plug is inserted, and an opposite end-side insertion portion formed at an opposite end of the terminal body and into which the plug cord is inserted, at least the one end-side insertion portion and the opposite end-side insertion portion being formed in a cylindrical shape; and a cylindrical rubber member mounted on at least one of one end portion and an opposite end portion of the terminal body and into which the spark plug or the plug cord is inserted, wherein the rubber member includes:

an inner cylindrical portion inserted into a one end-side insertion portion or the opposite end-side insertion portion of the terminal body, an outer cylindrical portion positioned close to an outer periphery of the inner cylindrical portion and disposed with the terminal body interposed between the outer cylindrical portion and the inner cylindrical portion, and a connecting portion that connects a lower-most portion of the outer cylindrical portion to a portion of the inner cylindrical portion that extends below the lower-most portion of the outer cylindrical portion, and the inner cylindrical portion includes:

at least one annular protrusion extending radially outward from the inner cylindrical portion and coming into contact with an inner peripheral surface of the terminal body.

2. The plug cap according to claim 1, wherein the rubber member is mounted on the one end portion of the terminal body, the electrical connection portion includes:

a connector bracket having one end portion that comes into contact with the spark plug, and a leading end portion of the inner cylindrical portion, facing the opposite end of the terminal body, that extends to one end face of the connector bracket, or is positioned closer to the opposite end portion of the terminal body than the one end face of the connector bracket.

3. The plug cap according to claim 1, wherein at least one of the annular protrusion includes two annular portions formed on the inner cylindrical portion in a range of a length of the outer cylindrical portion.

4. The plug cap according to claim 3, wherein the spark plug includes:

a cylindrical metal shell; and an insulator inserted into the metal shell and having a rear end-side body portion exposed from the metal shell, a step portion and a cylindrical portion, positioned closer to the metal shell than the step portion, and formed on the outer periphery of the rear end-side body portion, with the rear end-side body portion being inserted into the one end-side insertion portion when the plug cap is connected to the spark plug, the rubber member is mounted on the one end portion of the terminal body, and the two annular protrusions are formed on the inner cylindrical portion at a position that faces the cylindrical portion of the rear end-side body portion when the plug cap is connected to the spark plug.

5. The plug cap according to claim 1, wherein a length of the inner cylindrical portion from the connecting portion is larger than a length of the outer cylindrical portion from the connecting portion.

6. The plug cap according to claim 1, wherein the rubber member includes a reduced-diameter portion, having a diameter that is reduced stepwise and/or continuously toward the opposite end portion of the terminal body opposite to the end portion of both of the end portions of the terminal body on which the rubber member is mounted, and the reduced-diameter portion is formed at a leading end portion of the outer cylindrical portion facing the opposite end portion of the terminal body portion.

7. A plug cap comprising:

an electrical connection portion that electrically connects a spark plug to a plug cord, the spark plug being connected to one end of the electrical connection portion and the plug cord being connected to an opposite end of the electrical connection portion;

a terminal body made of a resin provided on an outer periphery of the electrical connection portion and including a one end-side insertion portion formed at one end of the terminal body and into which the spark plug is inserted, and an opposite end-side insertion portion formed at an opposite end of the terminal body and into which the plug cord is inserted, at least the one end-side insertion portion and the opposite end-side insertion portion being formed in a cylindrical shape; and a cylindrical rubber member mounted on at least one of one end portion and an opposite end portion of the terminal body and into which the spark plug or the plug cord is inserted, wherein the rubber member includes:

an inner cylindrical portion inserted into a one end-side insertion portion or the opposite end-side insertion portion of the terminal body, an outer cylindrical portion positioned close to an outer periphery of the inner cylindrical portion and disposed with the terminal body interposed between the outer cylindrical portion and the inner cylindrical portion, and a connecting portion that connects a lower-most portion of the outer cylindrical portion to a portion of the inner cylindrical portion that extends below the lower-most portion of the outer cylindrical portion, and the inner cylindrical portion includes:

two annular protrusion extending radially outward from the inner cylindrical portion that come into contact with an inner peripheral surface of the terminal body.

8. The plug cap according to claim 7, wherein the rubber member is mounted on the one end portion of the terminal body, the electrical connection portion includes:

a connector bracket having one end portion that comes into contact with the spark plug, and a leading end portion of the inner cylindrical portion, facing the opposite end of the terminal body, that extends to one end face of the connector bracket, or is positioned closer to the opposite end portion of the terminal body than the one end face of the connector bracket.

9. The plug cap according to claim 8, wherein the spark plug includes:

a cylindrical metal shell; and an insulator inserted into the metal shell wherein a rear end-side body portion is exposed from the metal shell, a step portion and a cylindrical portion, positioned closer to the metal shell than the step portion, and formed on the outer periphery of the rear end-side body portion, with the rear end-side body portion inserted into the one end-side insertion portion when the plug cap is connected to the spark plug, the rubber member is mounted on the one end portion of the terminal body, and the two annular protrusions are formed on the inner cylindrical portion at a position that faces the cylindrical portion of the rear end-side body portion when the plug cap is connected to the spark plug.

10. The plug cap according to claim 7, wherein a length of the inner cylindrical portion from the connecting portion is larger than a length of the outer cylindrical portion from the connecting portion.

11. The plug cap according to claim 7, wherein the rubber member includes a reduced-diameter portion having a diameter that is reduced stepwise and/or continuously toward the opposite end portion of the terminal body opposite to the end portion of both of the end portions of the terminal body on which the rubber member is mounted, and the reduced-diameter portion is formed at a leading end portion of the outer cylindrical portion facing the opposite end portion of the terminal body portion.

12. The plug cap according to claim 7, wherein the outer cylindrical portion includes an annular engaged portion having a concave shape formed on an inner peripheral surface at a lower-most portion of the inner cylindrical portion of the rubber member.

13. A plug cap comprising:

an electrical connection portion that electrically connects a spark plug to a plug cord, the spark plug being connected to one end of the electrical connection portion and the plug cord being connected to an opposite end of the electrical connection portion;

a terminal body made of a resin is provided on an outer periphery of the electrical connection portion and includes a one end-side insertion portion formed at one end of the terminal body and into which the spark plug is inserted, and an opposite end-side insertion portion formed at an opposite end of the terminal body and into which the plug cord is inserted, at least the one end-side insertion portion and the opposite end-side insertion portion being formed in a cylindrical shape; and a cylindrical rubber member mounted on at least one of one end portion and an opposite end portion of the terminal body and into which the spark plug or the plug cord is inserted, wherein the rubber member includes:

an inner cylindrical portion inserted into a one end-side insertion portion or the opposite end-side insertion portion of the terminal body, an outer cylindrical portion positioned close to an outer periphery of the inner cylindrical portion and disposed with the terminal body interposed between the outer cylindrical portion and the inner cylindrical portion, and a connecting portion that connects a lower-most portion of the outer cylindrical portion to a portion of the inner cylindrical portion that extends below the lower-most portion of the outer cylindrical portion, and the inner cylindrical portion includes:

at least one annular protrusion extending radially outward from the inner cylindrical portion and coming into contact with an inner peripheral surface of the terminal body, and at least one of the annular protrusions extending radially outward is arranged directly facing an annular engaged portion formed on the inner peripheral surface at the lower-most portion of the inner cylindrical portion of the rubber member.

14. The plug cap according to claim 13, wherein the rubber member is mounted on the one end portion of the terminal body, the electrical connection portion includes:

a connector bracket having one end portion that comes into contact with the spark plug, and a leading end portion of the inner cylindrical portion, facing the opposite end of the terminal body, that extends to one end face of the connector bracket, or is positioned closer to the opposite end portion of the terminal body than the one end face of the connector bracket.

15. The plug cap according to claim 13, wherein at least one of the annular protrusion includes two annular portions are provided at the inner cylindrical portion, and are formed on the inner cylindrical portion in a range of a length of the outer cylindrical portion.

16. The plug cap according to claim 15, wherein the spark plug includes:

a cylindrical metal shell; and an insulator inserted into the metal shell wherein a rear end-side body portion is exposed from the metal shell, a step portion and a cylindrical portion, positioned closer to the metal shell than the step portion, and formed on the outer periphery of the rear end-side body portion, with the rear end-side body portion inserted into the one end-side insertion portion when the plug cap is connected to the spark plug, the rubber member is mounted on the one end portion of the terminal body, and the two annular protrusions are formed on the inner cylindrical portion at a position that faces the cylindrical portion of the rear end-side body portion when the plug cap is connected to the spark plug.

17. The plug cap according to claim 13, wherein a length of the inner cylindrical portion from the connecting portion is larger than a length of the outer cylindrical portion from the connecting portion.

18. The plug cap according to claim 13, wherein the rubber member includes a reduced-diameter portion having a diameter reduced stepwise and/or continuously toward the opposite end portion of the terminal body opposite to the end portion of both of the end portions of the terminal body on which the rubber member is mounted, and the reduced-diameter portion is formed at a leading end portion of the outer cylindrical portion facing the opposite end portion of the terminal body portion.

* * * * *